US010358305B2

(12) United States Patent
Kawashima et al.

(10) Patent No.: US 10,358,305 B2
(45) Date of Patent: Jul. 23, 2019

(54) IMAGE FORMING APPARATUS

(71) Applicant: CANON KABUSHIKI KAISHA, Tokyo (JP)

(72) Inventors: Tomomichi Kawashima, Numazu (JP); Satoshi Tsuda, Mishima (JP); Joji Goto, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/881,168

(22) Filed: Jan. 26, 2018

(65) Prior Publication Data

US 2018/0222704 A1 Aug. 9, 2018

(30) Foreign Application Priority Data

Feb. 3, 2017 (JP) ..... 2017-018969

(51) Int. Cl.

| | |
|---|---|
| ***B65H 1/04*** | (2006.01) |
| ***B65H 3/06*** | (2006.01) |
| ***G03G 15/00*** | (2006.01) |
| ***G03G 21/16*** | (2006.01) |

(52) U.S. Cl.

CPC ..... *B65H 1/04* (2013.01); *B65H 3/06* (2013.01); *G03G 15/6511* (2013.01); *G03G 21/1647* (2013.01); *G03G 21/1695* (2013.01); *B65H 2402/441* (2013.01); *B65H 2402/45* (2013.01); *B65H 2405/10* (2013.01); *B65H 2405/332* (2013.01); *B65H 2601/255* (2013.01); *B65H 2601/521* (2013.01); *B65H 2801/06* (2013.01);

(Continued)

(58) Field of Classification Search

CPC ..... B65H 1/00; B65H 1/04; B65H 2402/441; B65H 2402/45; B65H 2405/10; B65H 2405/332; B65H 2601/255; B65H 2601/521; G03G 21/1647; G03G 21/1695

USPC ..... 271/9.11

See application file for complete search history.

(56) References Cited

U.S. PATENT DOCUMENTS 5,049,946 A * 9/1991 Harada ..... G03G 15/234 355/24
5,666,595 A * 9/1997 Sameshima ..... G03G 15/00 24/658

(Continued)

FOREIGN PATENT DOCUMENTS

JP 2004-359364 A 12/2004
JP 2006-131390 A 5/2006

(Continued)

*Primary Examiner* — Prasad V Gokhale
(74) *Attorney, Agent, or Firm* — Venable LLP

(57) ABSTRACT

An image forming apparatus includes a feeding apparatus feeding a recording material and a protruding member that protrudes downward from an apparatus main body; wherein when the feeding apparatus is installed below the apparatus main body, the protruding member is provided in a bottom portion of the apparatus main body so that inside the feeding apparatus the protruding member does not come into contact with a movable unit which is provided in the feeding apparatus so as to be movable with respect to the feeding apparatus, and the protruding member is positioned on an outer side of a feeding path of the recording material in the feeding apparatus, and moreover the protruding member penetrates more inward than an external surface of the feeding apparatus from above the feeding apparatus.

9 Claims, 10 Drawing Sheets

(52) U.S. Cl.
CPC ..... *G03G 21/1633* (2013.01); *G03G 21/1638* (2013.01)

(56) References Cited

U.S. PATENT DOCUMENTS

| | | | | |
|---|---|---|---|---|
| 7,505,707 | B2 * | 3/2009 | Makino | G03G 15/6502 399/107 |
| 7,529,499 | B2 * | 5/2009 | Makino | G03G 15/6502 271/9.01 |
| 8,787,814 | B2 | 7/2014 | Watanabe et al. | |
| 2009/0302521 | A1 * | 12/2009 | Kondo | B65H 1/04 271/9.01 |
| 2013/0068870 | A1 * | 3/2013 | Feldstein | B65H 75/30 242/381 |
| 2014/0001696 | A1 * | 1/2014 | Yoshida | B65H 5/00 271/9.01 |
| 2015/0084264 | A1 * | 3/2015 | Hino | B65H 85/00 271/3.18 |
| 2016/0320734 | A1 * | 11/2016 | Iwasawa | G03G 15/6502 |

FOREIGN PATENT DOCUMENTS

| | | | | |
|---|---|---|---|---|
| JP | 2008-195496 | A | 8/2008 | |
| JP | 2011215261 | A * | 10/2011 | B65H 3/44 |
| JP | 2012-051675 | A | 3/2012 | |

* cited by examiner

IMAGE FORMING APPARATUS

BACKGROUND OF THE INVENTION

Field of the Invention

The present invention relates to an image forming apparatus using an electrophotographic system such as a copier and a printer.

Description of the Related Art

Image forming apparatuses configured with a cassette attachably and detachably provided with respect to an image forming apparatus main body are in widespread use. For example, with a configuration in which a cassette is provided in a lower part of an image forming apparatus, a sheet pick-up portion and an image forming portion are respectively provided above the cassette and a sheet feeding path for guiding a sheet material (a recording material) is provided between the sheet pick-up portion and the image forming portion. The sheet material housed in the cassette is fed by the sheet pick-up portion and fed to the image forming unit along the sheet feeding path. With conventional image forming apparatuses, since a front end or a surface of the sheet material rubs against the sheet feeding path when passing through the sheet feeding path, a rubbing noise is created. The rubbing noise may leak to the outside and contribute to operation noise. Meanwhile, in case a fed sheet material jams inside a sheet feeding path, conventional image forming apparatuses are provided with an openable and closable access cover on an outer side of the sheet feeding path to enable handling of the jammed sheet material by opening the sheet feeding path. With an image forming apparatus provided with an access cover, an appropriate gap must be secured in advance between the access cover and surrounding structures such as an exterior cover and a frame in order to arrange the access cover so as not to interfere with the surrounding structures when being opened or closed.

However, when a gap is provided between the access cover and the surrounding structures, noise generated inside the image forming apparatus including the rubbing noise described above ends up leaking to the outside. In consideration thereof, a configuration is proposed in which an elastically deformable sound-insulating member is mounted to an access cover in order to fill a gap between the access cover and an image forming apparatus main body and prevent noise from leaking to the outside (refer to Japanese Patent Application Laid-open No. 2004-359364). In addition, in conventional image forming apparatuses, a configuration in which a feeding apparatus is added as an option to a lower side of an image forming apparatus main body to enable feeding of sheet materials of different types and sheet materials in large volumes is also commonly adopted. The optional feeding apparatus is also constituted by a cassette, a sheet pick-up portion, a sheet feeding path, and an access cover to accommodate jamming on the sheet feeding path. A configuration is proposed in which a sound-insulating member is provided in a bottom portion of an image forming apparatus main body in order to prevent, when an optional feeding apparatus is added to the image forming apparatus main body, noise generated in the image forming apparatus main body or the optional feeding apparatus from leaking to the outside (Japanese Patent Application Laid-open No. 2012-51675).

According to Japanese Patent Application Laid-open No. 2012-51675, since the sound-insulating member gets in the way when opening and closing the access cover of the optional feeding apparatus, when mounting the optional feeding apparatus, the access cover must be detached from the image forming apparatus main body and mounted to the bottom portion of the optional feeding apparatus. However, when a user inadvertently adds the optional feeding apparatus while forgetting to detach the sound-insulating member, a problem occurs in that the sound-insulating member is sandwiched between the image forming apparatus and the optional feeding apparatus and breaks. In consideration thereof, a depressed portion is provided on an upper surface of the optional feeding apparatus and, when the optional feeding apparatus is added in a state where the sound-insulating member is mounted to the image forming apparatus main body, the sound-insulating member enters the depressed portion and is prevented from breaking.

SUMMARY OF THE INVENTION

As described in Japanese Patent Application Laid-open No. 2004-359364, when a sound-insulating member is provided on an opening and closing access cover in a conventional image forming apparatus, since the sound-insulating member repetitively comes into contact with surrounding structures every time the access cover is opened or closed, there is a risk that operability of the access cover may decline. In addition, the repetitive contact between the sound-insulating member and the surrounding structure causes the sound-insulating member to deteriorate over time. Furthermore, there is a risk that a position of the sound-insulating member may become displaced or that the sound-insulating member becomes detached. Moreover, when a depressed portion into which the sound-insulating member enters is provided on the upper surface of an optional feeding apparatus in order to prevent the sound-insulating member from breaking as described in Japanese Patent Application Laid-open No. 2012-51675, a size of the optional feeding apparatus may increase and, in turn, a size of an image forming apparatus main body may increase. In other words, in order to secure space for providing a depressed portion between the access cover and a sheet feeding path of the optional feeding apparatus, a sufficient distance must be secured between the access cover constituting an external surface and the sheet feeding path. The image forming apparatus main body is provided with a main body-side sheet feeding path at a position corresponding to the sheet feeding path of the added optional feeding apparatus. In addition, since sizes of projections of the image forming apparatus main body and the optional feeding apparatus on installation surfaces thereof are the same when taking design into consideration, an external surface forming an outer shape of the access cover of the optional feeding apparatus and an external surface forming an outer shape of the image forming apparatus main body are approximately the same surface. In other words, the image forming apparatus main body ends up being configured with a sufficient distance between the external surface and the sheet feeding path in a similar manner to the optional feeding apparatus. Therefore, providing a depressed portion into which the sound-insulating member enters on the upper surface of the optional feeding apparatus results in increasing the size of the image forming apparatus.

In consideration thereof, an object of the present invention is to provide an image forming apparatus capable of achieving noise reduction even when a feeding apparatus is mounted thereto.

In order to achieve the object described above, an image forming apparatus according to the present invention includes:

an image forming apparatus, comprising:

a feeding apparatus that feeds a recording material;

an apparatus main body to which the feeding apparatus can be mounted; and a protruding member that protrudes downward from the apparatus main body, wherein the image forming apparatus forms an image on a recording material fed from the feeding apparatus, and wherein when the feeding apparatus is installed below the apparatus main body, the protruding member is provided in a bottom portion of the apparatus main body so that inside the feeding apparatus the protruding member does not come into contact with a movable unit which is provided in the feeding apparatus so as to be movable with respect to the feeding apparatus, and the protruding member is positioned on an outer side of a feeding path of the recording material in the feeding apparatus, and moreover the protruding member penetrates more inward than an external surface of the feeding apparatus from above the feeding apparatus.

According to the present invention, an image forming apparatus capable of achieving noise reduction even when a feeding apparatus is mounted thereto can be provided.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
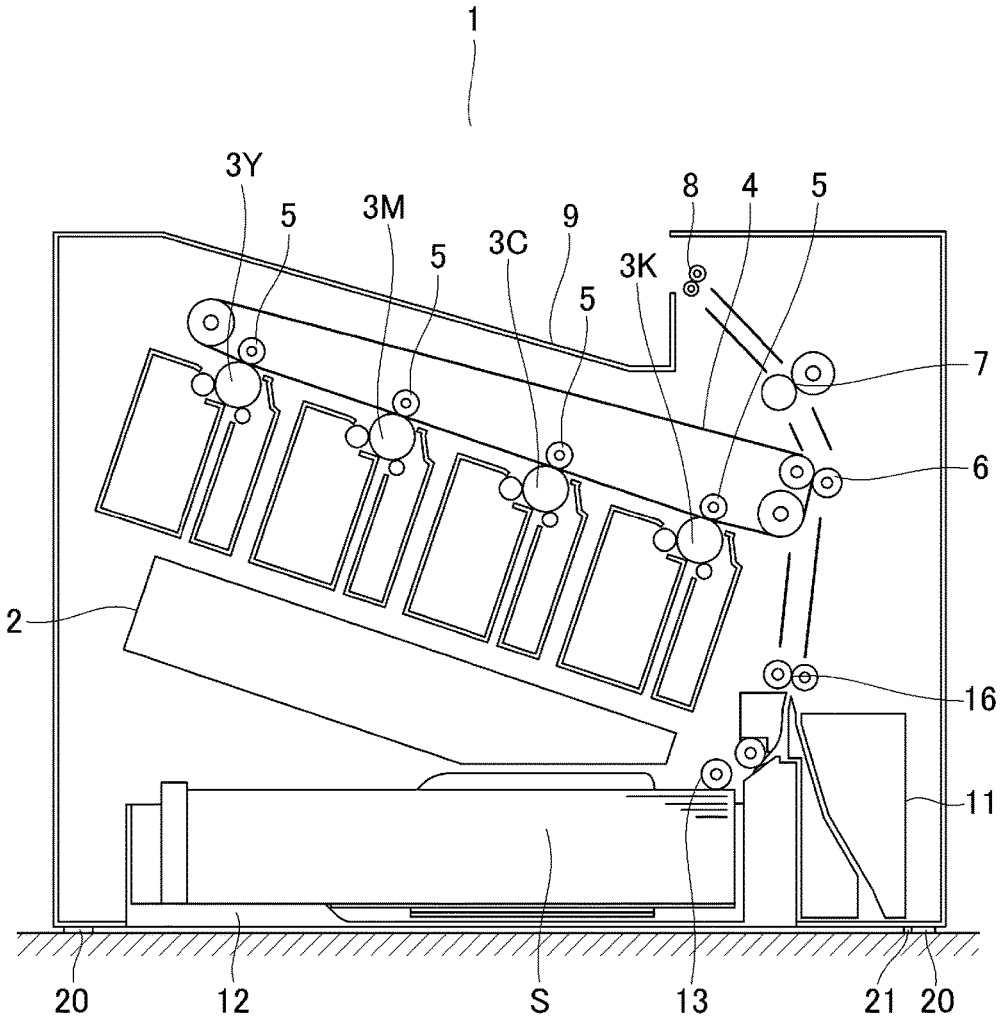
FIG. 1 is a sectional view of an image forming apparatus main body according to the present invention.
Figure 2:
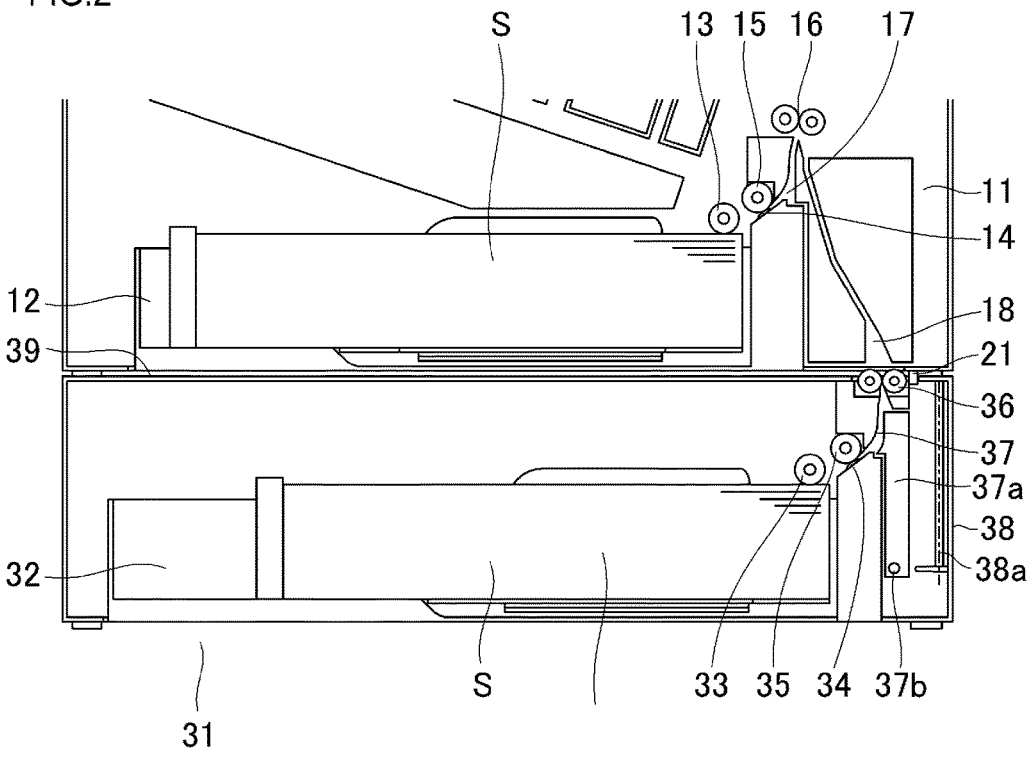
FIG. 2 is a sectional view of an image forming apparatus main body and an optional feeding apparatus according to a first embodiment.
Figure 3:
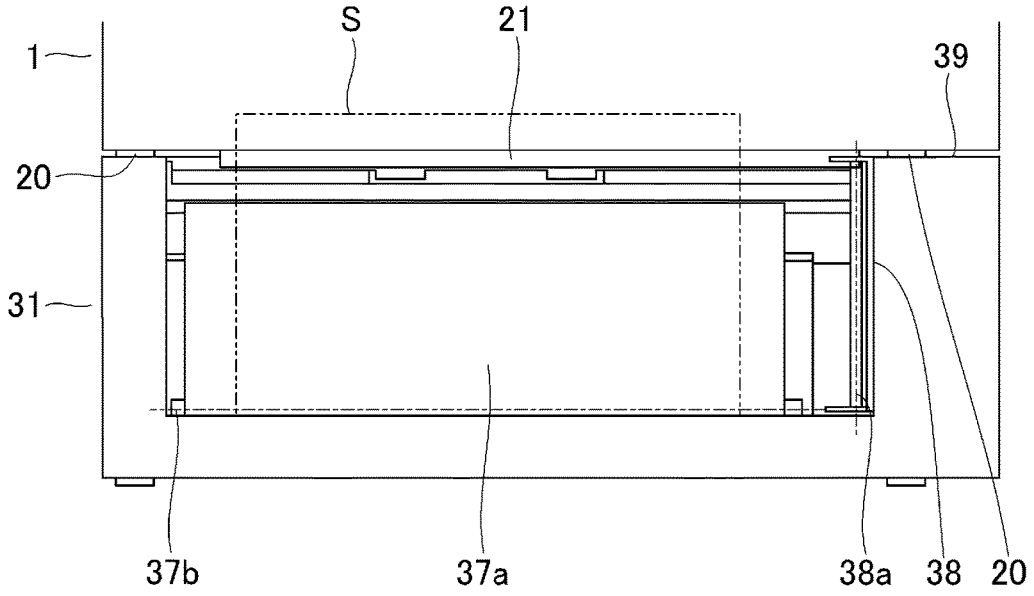
FIG. 3 is a side view of an image forming apparatus main body and an optional feeding apparatus according to a first embodiment.
Figure 4:
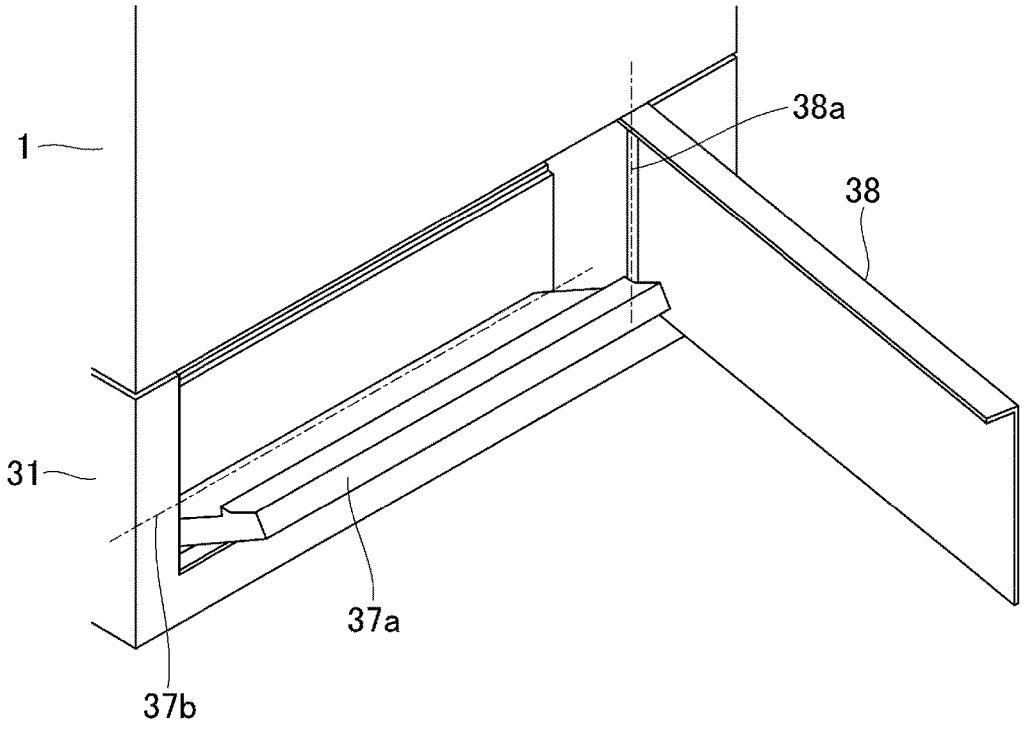
FIG. 4 is perspective view of a state in which an access cover and a feeding guide according to the first embodiment are opened.

Hereinafter, a first embodiment of the present invention will be described with reference to the drawings. FIG. 1 is a sectional view showing a schematic configuration of an image forming apparatus main body according to the first embodiment of the present invention. FIG. 2 is a sectional view showing a schematic configuration of the image forming apparatus main body and an optional feeding apparatus according to the first embodiment of the present invention. FIG. 3 is a side view showing a schematic configuration of the image forming apparatus main body and the optional feeding apparatus according to the first embodiment of the present invention in a state in which an access cover is opened. FIG. 4 is a perspective view showing a schematic configuration of the image forming apparatus main body and the optional feeding apparatus according to the first embodiment of the present invention in a state in which an access cover and a feeding guide are opened. In FIGS. 1 and 2, reference numeral 1 denotes an image forming apparatus main body (hereinafter, referred to as an apparatus main body). In this case, the image forming apparatus is an apparatus which uses known electrophotographic techniques to form a toner image based on externally-input image information and to transfer and fix a color image on a medium such as paper, and examples thereof include a copier, a laser beam printer, and a facsimile apparatus. In the present embodiment, a color laser beam printer will be described as an example. In addition, a process cartridge refers to an integrated cartridge which is constituted by at least a developing unit and an electrophotographic image bearing member (a photosensitive drum) as a processing unit and which is attachable to and detachable from the image forming apparatus main body.

First, a configuration and functions of the apparatus main body 1 will be described with reference to FIGS. 1 and 2. The apparatus main body 1 is mainly constituted by a paper feeding apparatus 11, an exposing unit 2, a process cartridge 3, an intermediate transfer belt 4, a primary transferring unit 5, a secondary transferring unit 6, a fixing unit 7, and a protruding member 21. At least the exposing unit 2, process cartridge 3, intermediate transfer belt 4, primary transferring unit 5, secondary transferring unit 6, and fixing unit 7 can be considered an image forming portion, but such is not considered to be limiting. More or fewer components or even different components can be considered as the image forming portion. As shown in FIG. 2, the paper feeding apparatus 11 is mainly provided with a cassette 12 which houses a stack of a sheet material S and which is attachably and detachably provided to and from the apparatus main body 1 and a paper feeding roller 13 which feeds the sheet material S. In addition, a feeding roller 15 which, by using separating unit 14, separates the fed sheet material S into individual sheets before feeding the same, a feeding roller 16 which feeds the individual sheets, and a feeding path 17 which guides the sheet material S fed from the feeding roller 15 to the feeding roller 16 are also provided. Furthermore, the paper feeding apparatus 11 is provided with a feeding path 18 which guides the sheet material S fed from an optional feeding apparatus 31 (to be described later) to the feeding roller 16.

The protruding member 21 (a sound-insulating member) is provided in a lower part (a bottom portion) of the apparatus main body 1 and a tip portion of the protruding member 21 protrudes downward. As shown in FIG. 3, the protruding member 21 is shaped elongated in a front-back direction of the apparatus main body 1 to ensure that noise generated inside the apparatus main body 1 does not leak to the outside. In this case, a side on which a turning shaft 38*a* of an access cover 38 in FIG. 3 is present is assumed to be a back side of the apparatus main body and an opposite side thereof is assumed to be a front side of the apparatus main body. A length of the protruding member 21 in the front-back direction of the apparatus main body 1 in the present embodiment is longer than a width of a fed sheet material S.

FIG. 1 represents a tandem-type color image forming apparatus in which four process cartridges 3Y, 3M, 3C, and 3K are arranged on a straight line. The four process cartridges 3Y, 3M, 3C, and 3K share a same structure, respectively correspond to the four colors of yellow (hereinafter, Y), magenta (hereinafter, M), cyan (hereinafter, C), and black (hereinafter, K), and form toner images of the respective colors so as to overlap with one another on a rotating intermediate transfer belt 4. The process cartridge 3 is mainly constituted by a photosensitive drum 3*a*, charging unit 3*b*, and developing unit 3*c*. The charging unit 3*b*, an exposing portion constituted by the exposing unit 2, the developing unit 3*c*, and a primary transferring portion constituted by the primary transferring unit 5 are respectively arranged around the photosensitive drum 3*a* in this order from upstream in a rotation direction of the photosensitive drum 3*a* during image formation.

Next, operations of the apparatus main body 1 will be described with reference to FIGS. 1 and 2. The photosensitive drum 3*a* having been uniformly charged by the charging unit 3*b* is irradiated by a laser beam in accordance with image information from the exposing unit 2 and an electrostatic latent image is formed. The electrostatic latent image is developed using a toner of each color by the developing unit 3*c* and a visible image or, in other words, a toner image is formed. The toner image formed on a surface of the photosensitive drum 3*a* of the process cartridge 3 is transferred onto a surface of the intermediate transfer belt 4 which is a toner image bearing member by the primary transferring unit 5. Meanwhile, when a paper feed signal is output from a control portion (not shown) in accordance with image information, the paper feeding roller 13 rotates under power supplied from a motor (not shown) and feeds a topmost sheet material S among the sheet material S stacked in the cassette 12. The sheet material S fed out from the paper feeding roller 13 is separated into individual sheets and fed by the feeding roller 15 and the separating unit 14. Subsequently, the sheet material S is guided to the feeding path 17 and fed along the feeding path 17 to the feeding roller 16 and the secondary transferring unit 6. The toner image formed on the intermediate transfer belt 4 is transferred to the sheet material S by the secondary transferring unit 6 and fed to the fixing unit 7. At the fixing unit 7, the toner image is fixed onto the sheet material S by heat and pressure. Subsequently, the sheet material S is fed by a discharge roller 8 and discharged onto a discharge tray 9 provided in an upper part of the apparatus main body 1.

In the present embodiment, the optional feeding apparatus 31 as a mountable feeding apparatus can be added to a lower side of the apparatus main body 1. The optional feeding apparatus 31 has approximately the same functions as the paper feeding apparatus 11 of the apparatus main body 1, but is additionally equipped with a function as a structure which supports the apparatus main body 1 from below. First, a configuration and functions of the optional feeding apparatus 31 will be described with reference to FIGS. 2 to 4. The optional feeding apparatus 31 is mainly provided with a cassette 32 which houses a stack of the sheet material S and which is attachably and detachably provided to and from a main body of the optional feeding apparatus 31 and a paper feeding roller 33 which feeds the sheet material S. The optional feeding apparatus 31 is additionally constituted by a feeding roller 35 which separates the fed sheet material S into individual sheets using separating unit 34, a feeding roller 36 (a feeding member or feeding roller pair) which feeds the individual sheets, and a feeding path 37 which guides the sheet material S fed from the feeding roller 35 to the feeding roller 36. In a feeding guide structure forming the feeding path 37 of the optional feeding apparatus 31, an outer-side feeding guide 37*a* is provided so as to be openable and closable around a turning shaft 37*b* as shown in FIG. 4. In addition, in a vicinity of the feeding guide 37*a*, the outer-side access cover 38 (a movable portion) is movably provided so as to be openable and closable around the turning shaft 38*a* provided at one end of the apparatus main body 1 in the front-back direction and, by opening the access cover 38, the feeding guide 37*a* can be opened.

Figure 5:
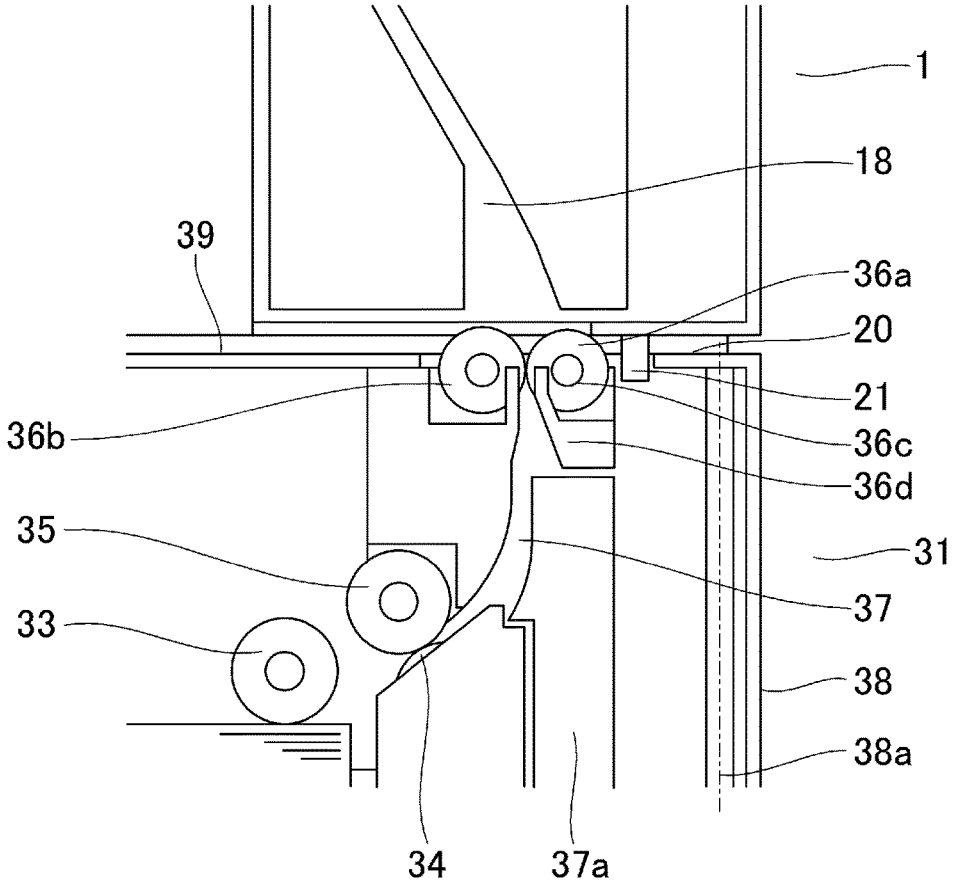
FIG. 5 is a partial enlarged view of a case where a protruding member is provided on an outer side of a feeding guide in the first embodiment.

Next, operations of the optional feeding apparatus 31 will be described with reference to FIGS. 2 to 4. When a paper feed signal is output from a control portion (not shown) in accordance with image information, the paper feeding roller 33 rotates under power supplied from a motor (not shown) and feeds a topmost sheet material S among the sheet material S stacked in the cassette 32. The sheet material S fed out from the paper feeding roller 33 is separated into individual sheets and fed by the feeding roller 35 and the separating unit 34. Subsequently, the sheet material S is guided to the feeding path 37 and fed along the feeding path 37 to the feeding roller 36. Moreover, the sheet material S is fed from the feeding roller 36 of the optional feeding apparatus 31 to the feeding path 18 of the apparatus main body 1. At this point, when a paper jam occurs on the feeding path 37, the optional feeding apparatus 31 opens the feeding guide 37*a* which forms the feeding path 37. In the present embodiment, the feeding guide 37*a* is opened after opening the access cover 38 which is an opening and closing member provided so as to be openable and closable. FIG. 5 shows an example of a case where the optional feeding apparatus 31 is added to the apparatus main body 1 and the protruding member 21 is provided in a bottom portion of the apparatus main body 1. As shown in FIG. 5, the protruding member 21 is arranged on an outer side of the feeding guide 37*a*. The protruding member 21 penetrates into an inner side of the optional feeding apparatus 31 relative to an external surface 39 of an upper side of the optional feeding apparatus 31. Therefore, even when the sheet material S is fed from the optional feeding apparatus 31 and the sheet material S rubs against the feeding path 37 to generate a rubbing noise, since the protruding member 21 is interposed between the feeding path 37 and the outside of the apparatus, the rubbing noise generated inside the apparatus is prevented from leaking to the outside.

In addition, in the present embodiment, since the protruding member 21 is arranged on an inner side relative to an opening and closing region of the access cover 38, the protruding member 21 and the access cover 38 do not come into contact with each other during opening and closing operations of the access cover 38. The protruding member 21 need only be capable of blocking noise generated inside the apparatus so that the noise does not leak to the outside. A material of the protruding member 21 may be, for example, an elastic member such as a sheet material made of PET or a sponge, and the protruding member 21 is fixed to the bottom portion of the apparatus main body 1 by an adhesive such as a double-sided tape.

Figure 6:
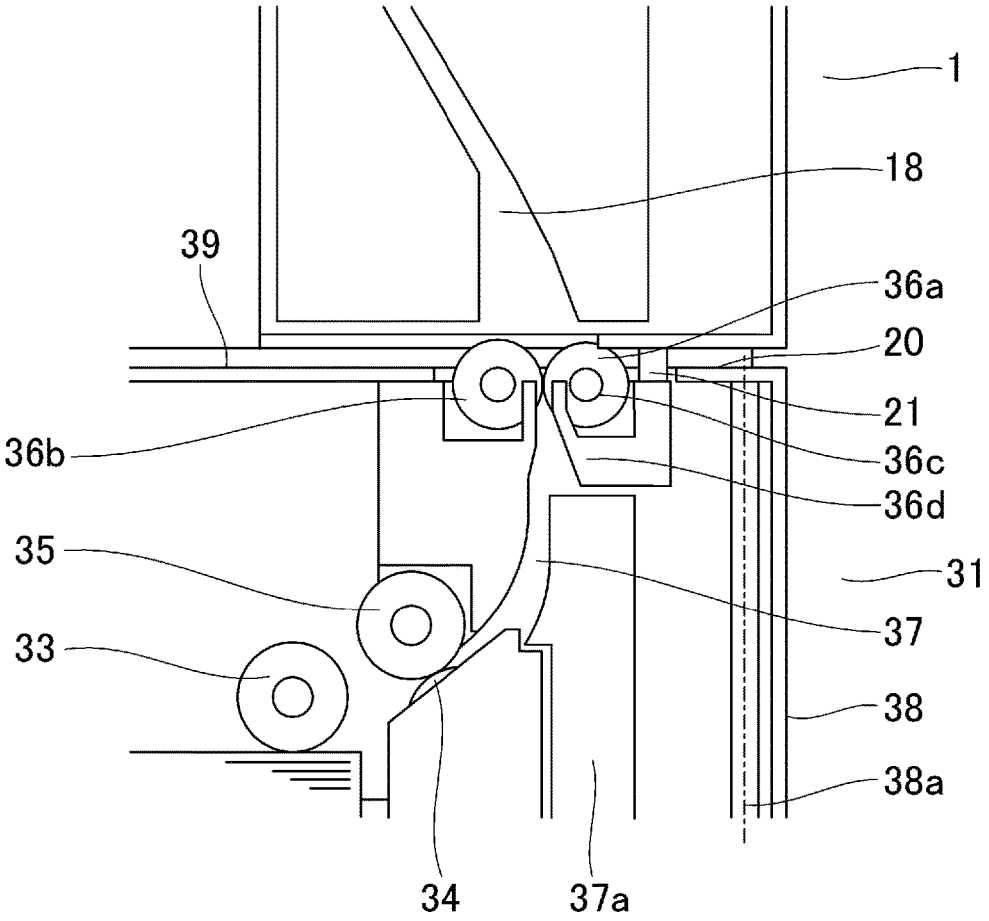
FIG. 6 is a partial enlarged view of a case where a tip of a protruding member comes into contact with a feeding guide in the first embodiment.

FIG. 6 shows another example of a case where the optional feeding apparatus 31 is added to the apparatus main body 1 and the protruding member 21 is provided. As shown in FIG. 6, the protruding member 21 is also capable of producing a higher noise reduction effect by coming into contact with a part of the optional feeding apparatus 31 and shielding a space between the feeding path 37 and the outside of the apparatus. FIG. 6 shows a configuration in which a tip of the protruding member 21 is in contact with a feeding guide or guide member 36*d* of the optional feeding apparatus 31. Even when the apparatus main body 1 is independently installed on an installation surface, by blocking a gap between the apparatus main body 1 and the installation surface with the protruding member 21, noise generated inside the apparatus main body 1 is prevented from leaking to the outside. In other words, even when a rubbing noise is generated due to the sheet material S fed out from the paper feeding roller 13 rubbing against the feeding path 17, the protruding member 21 is interposed between the feeding path 17 and the outside of the apparatus main body 1. As a result, noise generated inside the apparatus main body 1 is prevented from leaking from a gap between the apparatus main body 1 and the installation surface.

Adopting a configuration in which the tip of the protruding member 21 protrudes more downward than a contact surface 20 which comes into contact with the installation surface when installing the apparatus main body 1 enables shielding to be performed without creating a gap between the apparatus main body 1 and the installation surface, and a higher sound-insulating effect can be produced. Furthermore, configuring the protruding member 21 as an elastic member enables the protruding member 21 to elastically deform by being compressed between the apparatus main body 1 and the installation surface and block a gap even in cases where the installation surface is not flat. Therefore, a sound-insulating effect can be produced regardless of a state of the installation surface. As described above, by providing the protruding member 21 in a bottom portion of the apparatus main body 1 to block a gap between the apparatus main body 1 and an installation surface which is created when installing the apparatus main body 1, noise generated inside the apparatus main body 1 can be prevented from leaking to the outside.

In addition, when the optional feeding apparatus 31 is added to a lower side of the apparatus main body 1, the protruding member 21 is arranged on an outer side of the feeding path 37 at a position where the protruding member 21 does not come into contact with the access cover 38 of the optional feeding apparatus 31. Furthermore, due to the protruding member 21 penetrating more inward than the external surface 39 of an upper side of the optional feeding apparatus 31, noise generated inside the apparatus main body 1 or inside the optional feeding apparatus 31 can be prevented from leaking to the outside. Therefore, noise reduction can be achieved even in a product mode in which a sound-insulating member is arranged inside an image forming apparatus and an optional feeding apparatus is added to the image forming apparatus while securing usability without increasing apparatus size.

Second Embodiment

Figure 7:
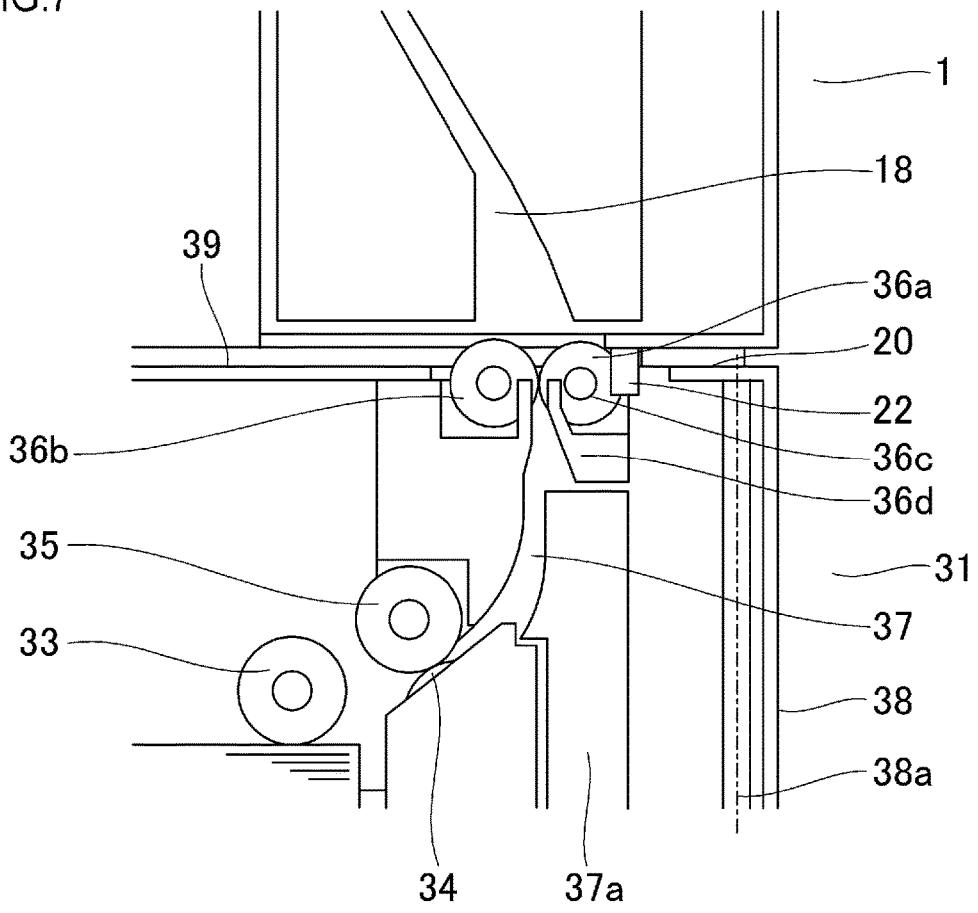
FIG. 7 is a diagram showing a protruding member positioned on a center side with respect to an outer diameter of a feeding roller in a second embodiment.
Figure 8:
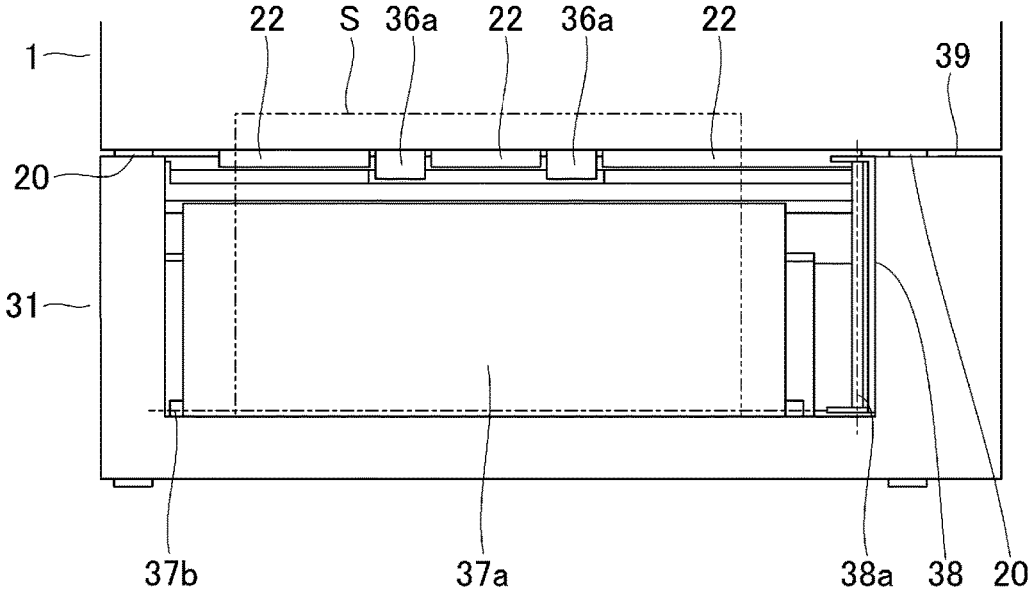
FIG. 8 is a side view showing a protruding member being divided in a front-back direction of an apparatus main body in the second embodiment.

In a second embodiment, an arrangement and a shape of a protruding member which enable, with a different configuration from the first embodiment, further downsizing of an apparatus will be described. Moreover, only portions which differ from the first embodiment will be described and, since other portions are the same as the first embodiment, a description thereof will be omitted. Hereinafter, a description will be given with reference to the drawings. First, a configuration and functions of the apparatus main body 1 will be described with reference to FIGS. 7 and 8. FIG. 7 is a sectional view showing a positional relationship between a protruding member and a feeding roller according to the present embodiment. In addition, FIG. 8 is a side view showing a positional relationship between a protruding member and a feeding roller according to the present embodiment. A protruding member 22 is provided in a bottom portion of the apparatus main body 1 and a tip portion of the protruding member 22 protrudes downward. Furthermore, while the protruding member 22 is arranged in a region which is longer than the width of the sheet material S in the front-back direction of the apparatus main body 1, the protruding member 22 is divided so as to be positioned on both sides of a feeding roller 36. Specifically, the protruding member 22 is provided in plurality, and the plurality of protruding members 22 are arranged so as to sandwich the feeding roller 36, with one of the plurality of protruding members 22 from one of both sides of the feeding roller 36 and another of the plurality of protruding members 22 from the other side of the feeding roller 36. As shown in FIG. 8, the divided regions correspond to positions of a roller portion 36*a* on an outer side of the feeding roller 36. In addition, as shown in FIG. 7, the protruding member 22 is arranged so as to penetrate on a center side relative to an outer diameter of the roller portion 36*a*. Specifically, the protruding member 22 is to be arranged approximately side by side with the roller portion 36*a* on the outer side of the feeding roller 36 in an axial direction of the roller portion 36*a*. However, since the protruding member 22 is divided as described earlier, the protruding member 22 and the roller portion 36*a* do not come into contact with each other. In other words, in a width direction perpendicular to a feeding direction of the sheet material S, the protruding member 22 and the roller portion 36*a* are positioned so as to be separated from each other.

In the present embodiment, the optional feeding apparatus 31 can be added as an option to a lower side of the apparatus main body 1 in a similar manner to the first embodiment. Next, operations of the optional feeding apparatus 31 will be described with reference to FIGS. 7 and 8. When the optional feeding apparatus 31 is added to the apparatus main body 1, the protruding member 22 is arranged on an outer side of the feeding guide 37*a*. The protruding member 22 penetrates into an inner side of the optional feeding apparatus 31 relative to the external surface 39 of an upper side of the optional feeding apparatus 31. In this case, since the roller portion 36*a* rotates together with the fed sheet material S, the roller portion 36*a* and the sheet material S do not rub against each other. Therefore, even when the sheet material S is fed from the optional feeding apparatus 31 and the sheet material S rubs against the feeding path 37 to generate a rubbing noise, since the protruding member 22 is interposed between the feeding path 37 and the outside of the apparatus, the rubbing noise generated inside the apparatus is prevented from leaking to the outside. In addition, in the present embodiment, since the protruding member 22 is arranged on an inner side relative to an opening and closing region of the access cover 38, the protruding member 22 and the access cover 38 do not come into contact with each other during opening and closing operations of the access cover 38. The protruding member 22 need only be capable of blocking noise generated inside the apparatus so that the noise does not leak to the outside. A material of the protruding member 22 may be, for example, an elastic member such as a sheet material made of PET or a sponge, and the protruding member 22 is fixed to the bottom portion of the apparatus main body 1 by an adhesive such as a double-sided tape.

Even when the apparatus main body 1 is independently installed on an installation surface, by blocking a gap between the apparatus main body 1 and the installation surface with the protruding member 22, noise generated inside the apparatus main body 1 is prevented from leaking to the outside. In other words, even when a rubbing noise is generated due to the sheet material S fed out from the paper feeding roller 13 rubbing against the feeding path 17, the protruding member 22 is interposed in most of the regions between the feeding path 17 and the outside of the apparatus main body 1. As a result, noise generated inside the apparatus main body 1 is prevented from leaking from a gap between the apparatus main body 1 and the installation surface. Adopting a configuration in which the tip of the protruding member 22 protrudes more downward than the contact surface 20 which comes into contact with the installation surface when installing the apparatus main body 1 enables shielding to be performed without creating a gap between the apparatus main body 1 and the installation surface and a higher sound-insulating effect can be produced. Furthermore, configuring the protruding member 22 as an elastic member enables the protruding member 22 to elastically deform by being compressed between the apparatus main body 1 and the installation surface and block a gap even in cases where the installation surface is not flat, and a sound-insulating effect can be produced regardless of the state of the installation surface. By dividing the protruding member 22 and arranging the protruding member 22 side by side with the feeding roller 36 as in the present embodiment, the protruding member 22 can be arranged on a further inner side of the apparatus by a length of the protruding member 22 in a transverse direction as compared to the first embodiment. As a result, a distance between the access cover which forms an external surface and the sheet feeding path can be reduced and, in turn, downsizing of the apparatus can be achieved.

Figure 10:
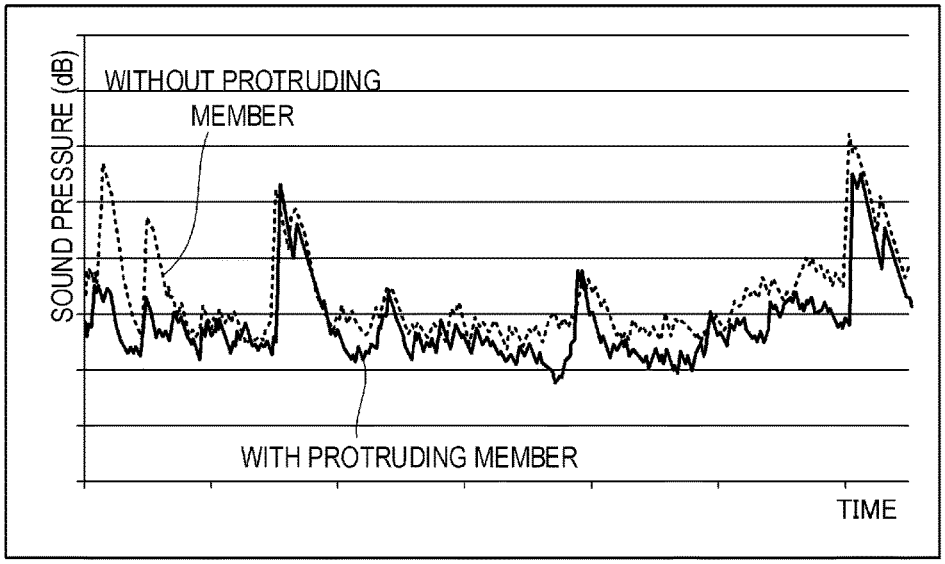
FIG. 10 is a diagram showing a noise reduction effect according to the present invention.

The noise reduction effect according to the present embodiment will be described with reference to FIG. 10. FIG. 10 is a graph showing results of noise measurement when the sheet material S is fed from the optional feeding apparatus 31 in a configuration in which the apparatus main body 1 is provided with the protruding member 22 and a configuration in which the protruding member 22 is not provided. A horizontal axis represents time from the start of feeding of the sheet material S by the paper feeding roller 33 to the sheet material S reaching the feeding roller 16. A vertical axis represents a logarithmic expression of a magnitude of sound pressure in units of dB. It is shown that the configuration provided with the protruding member 22 has a smaller dB value. In terms of average values for the measurement periods, the average value for the configuration provided with the protruding member 22 was approximately 64.94 dB while the configuration not provided with the protruding member 22 was approximately 65.83 dB, which represents a reduction effect of approximately 0.89 dB. Moreover, the protruding member 22 is even capable of producing a similar noise reduction effect with a configuration of a protruding member in which a divided region has a depressed shape.

Figure 9:
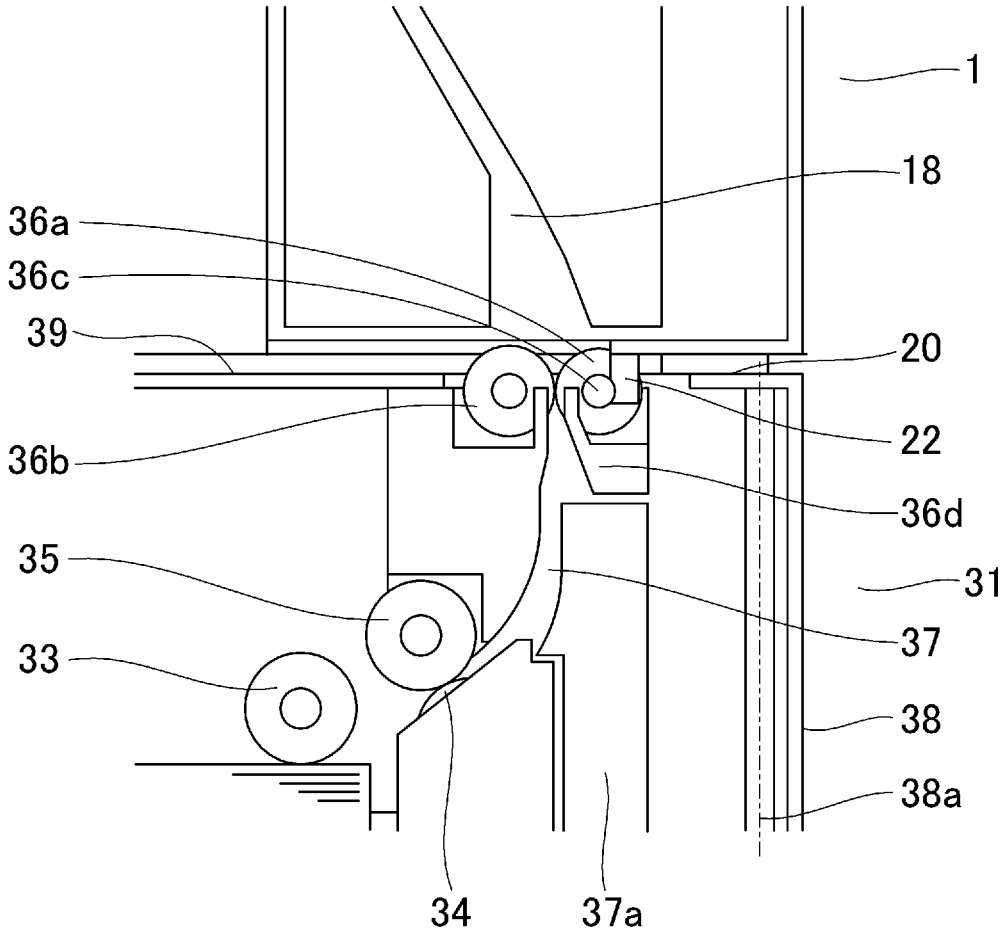
FIG. 9 is a diagram showing a case where a protruding member is in contact with a supporting portion of a feeding roller in the second embodiment.

In addition, adopting a configuration in which the roller portion 36*a* on the outer side of the feeding roller 36 is a driven roller and the roller portion 36*a* is supported by a driven roller shaft 36*c* (a supporting portion 36*c*) enables the protruding member 22 to be arranged in contact with the supporting portion 36*c*. A configuration in a case where the protruding member 22 is arranged in contact with the supporting portion 36*c* is shown in FIG. 9. In the feeding roller 36, a feeding roller arranged on an inner side is a driver roller 36*b* which provides drive and the roller portion 36*a* is a roller (a rotating body) which is driven to rotate. In addition, the roller portion 36*a* is pivotally supported by a driven roller shaft 36*c* which does not rotate and is provided so as to be rotatable on the driven roller shaft 36*c*. As shown in FIG. 9, by arranging the protruding member 22 in contact with the supporting portion 36*c*, a gap created between the feeding path 37 and the outside of the apparatus can be shielded in an effective manner and a higher sound-insulating effect can be produced.

As described above, by providing the protruding member 22 in a bottom portion of the apparatus main body 1 to block a gap between the apparatus main body 1 and an installation surface which is created when installing the apparatus main body 1, noise generated inside the apparatus main body 1 can be prevented from leaking to the outside. In addition, when the optional feeding apparatus 31 is added to a lower side of the apparatus main body 1, the protruding member 22 is arranged on an outer side of the feeding path 37 at a position where the protruding member 22 does not come into contact with the access cover 38 of the optional feeding apparatus 31. Furthermore, due to the protruding member 22 penetrating more inward in the optional feeding apparatus 31 than the external surface 39 of an upper side of the optional feeding apparatus 31, noise generated inside the apparatus main body 1 or inside the optional feeding apparatus 31 can be prevented from leaking to the outside. Therefore, noise reduction can be achieved while securing usability and without increasing apparatus size even in a product mode in which a sound-insulating member is arranged in an image forming apparatus and an optional feeding apparatus is added to the image forming apparatus.

Third Embodiment

In a third embodiment, a configuration which achieves noise reduction with a configuration that differs from the first and second embodiments will be described. Moreover, only portions which differ from the first and second embodiments will be described and, since other portions are the same as the first embodiment, a description thereof will be omitted. The protruding member 21 which shields a gap between the apparatus main body 1 and the optional feeding apparatus 31 is capable of producing a noise reduction effect even when provided on an upper surface of the optional feeding apparatus 31. For example, in the configuration shown in FIG. 6, even when the protruding member 21 is provided on the feeding guide 36*d* of the optional feeding apparatus 31, since the protruding member 21 is interposed between the feeding path 37 and the outside of the apparatus, a rubbing noise generated inside the apparatus can be prevented from leaking to the outside. By providing the protruding member in the optional feeding apparatus 31, when optional feeding apparatuses 31 are used stacked on top of one another, since gaps between the optional feeding apparatuses can be blocked by the protruding member, a noise reduction effect can be produced even when a plurality of optional feeding apparatuses are used stacked on top of one another.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-018969, filed on Feb. 3, 2017, which is hereby incorporated by reference herein in its entirety.

What is claimed is:

1. An image forming apparatus, comprising:

a main body having therein an image forming portion for forming an image on a recording material;

a feeding unit mountable on the main body for feeding the recording material to the image forming portion, the feeding unit comprising a feeding roller pair to feed the recording material to the image forming portion and being opposed to a lower surface of the main body, an external surface opposed to the lower surface of the main body, and a cover for opening and closing the inside of the feeding unit; and an elastic member to be positioned between the feeding roller pair and the cover of the feeding unit, the elastic member being provided so as to protrude from the lower surface of the main body to a position further inward than the external surface of the feeding unit, and the elastic member being positioned so as to overlap with the feeding roller pair when viewed from a direction perpendicular to a feeding direction of the feeding roller pair.

2. The image forming apparatus according to claim 1, wherein the elastic member is longer than a width of the recording material.

3. The image forming apparatus according to claim 1, wherein the elastic member is fixed to the lower surface of the main body by double-sided tape.

4. The image forming apparatus according to claim 1, wherein the feeding unit further comprises a guide member to guide feeding of the recording material with the feeding roller pair, and wherein the elastic member is in contact with the guide member.

5. The image forming apparatus according to claim 1, wherein the feeding unit further comprises a plurality of feeding roller pairs arranged along a width direction which is a roller axis direction of the feeding roller pairs, and wherein the elastic member is provided so as to overlap with the plurality of the feeding roller pairs when viewed from the direction perpendicular to the feeding direction of the feeding roller pairs.

6. An image forming apparatus, comprising:

a main body having therein an image forming portion for forming an image on a recording material;

a feeding unit mountable on the main body for feeding the recording material to the image forming portion, the feeding unit comprising a plurality of feeding roller pairs to feed the recording material to the image forming portion and being opposed to a lower surface of the main body, an external surface opposed to the lower surface of the main body, and a cover for opening and closing the inside of the feeding unit; and an elastic member to be positioned further inward than the cover of the feeding unit, wherein the elastic member is provided so as to shield a space between the external surface of the feeding unit and the lower surface of the main body, the plurality of feeding roller pairs are provided so as to be arranged along a roller axis direction of the feeding roller pairs, and the elastic member is positioned between at least two of the feeding roller pairs along the roller axis direction when viewed from a direction perpendicular to a feeding direction of the feeding roller pairs.

7. The image forming apparatus according to claim 6, wherein the elastic member is positioned on both sides of each of the plurality of the feeding roller pairs along the roller axis direction.

8. The image forming apparatus according to claim 6, wherein the elastic member is provided so as to protrude to a position further inward than the external surface of the feeding unit from the lower surface of the main body.

9. The image forming apparatus according to claim 6, wherein the elastic member is fixed to the lower surface of the main body by double-sided tape.

* * * * *